US010976047B2

(12) United States Patent
Weir et al.

(10) Patent No.: US 10,976,047 B2
(45) Date of Patent: Apr. 13, 2021

(54) ILLUMINATION FOR STORAGE UNITS

(71) Applicant: Snap-on Incorporated, Kenosha, WI (US)

(72) Inventors: Nicholas H. Weir, Hoffman, IL (US); Michael G. Gentile, Grayslake, IL (US); Thomas L. Kassouf, Port Washington, WI (US); Ben T. Schulz, Racine, WI (US); Ethan Hoefler, Kenosha, WI (US); Ottoleo Kuter-Arnebeck, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/538,400

(22) Filed: Aug. 12, 2019

(65) Prior Publication Data

US 2020/0063955 A1 Feb. 27, 2020

Related U.S. Application Data

(60) Provisional application No. 62/721,957, filed on Aug. 23, 2018.

(51) Int. Cl.
*F21V 33/00* (2006.01)
*F21V 23/04* (2006.01)
(Continued)

(52) U.S. Cl.
CPC ..... *F21V 33/0084* (2013.01); *A47B 88/919* (2017.01); *B25H 3/028* (2013.01);
(Continued)

(58) Field of Classification Search
CPC ..... F21V 33/0048; F21V 33/008; F21V 33/0084; F21V 33/0012; F21V 33/002;
(Continued)

(56) References Cited

U.S. PATENT DOCUMENTS 5,246,285 A * 9/1993 Redburn ..... F21S 9/02 312/223.5
6,102,548 A * 8/2000 Mantle ..... A47G 29/1209 232/13
(Continued)

FOREIGN PATENT DOCUMENTS

AT 10609 U1 * 7/2009 ..... F21V 23/04
CN 103465242 A 12/2013
(Continued)

OTHER PUBLICATIONS

Combined Search and Examination Report for Application No. GB1911851.2 dated Jan. 14, 2020, 8 pages.
(Continued)

*Primary Examiner* — Alexander K Garlen
*Assistant Examiner* — Colin J Cattanach
(74) *Attorney, Agent, or Firm* — Seyfarth Shaw LLP

(57) ABSTRACT

An illumination assembly for illuminating drawers of a storage unit, such as a cabinet or toolbox. The illumination assembly is adapted to be coupled to the storage unit by coupling the illumination assembly within a retrofittable or integrated feature of the storage unit to direct or radiate light into a containment space (such as a drawer) of the storage unit when opened. The illumination assembly may also illuminate a facade, sides, underside, or surrounding area of the storage unit.

21 Claims, 8 Drawing Sheets

(51) Int. Cl.

| | |
|---|---|
| ***F21V 3/00*** | (2015.01) |
| ***A47B 88/919*** | (2017.01) |
| ***B25H 3/02*** | (2006.01) |
| ***F21Y 115/10*** | (2016.01) |
| ***A47F 11/00*** | (2006.01) |
| ***F21W 131/301*** | (2006.01) |
| ***A47B 13/12*** | (2006.01) |
| ***F21W 131/405*** | (2006.01) |
| ***F25D 27/00*** | (2006.01) |
| ***A47F 7/00*** | (2006.01) |

(52) U.S. Cl.

CPC ..... *F21V 3/00* (2013.01); *F21V 23/0471* (2013.01); *A47B 13/12* (2013.01); *A47B 2200/005* (2013.01); *A47B 2200/0075* (2013.01); *A47B 2220/0077* (2013.01); *A47F 11/00* (2013.01); *A47F 2007/0085* (2013.01); *F21V 33/008* (2013.01); *F21V 33/0012* (2013.01); *F21V 33/0044* (2013.01); *F21V 33/0048* (2013.01); *F21W 2131/301* (2013.01); *F21W 2131/405* (2013.01); *F21Y 2115/10* (2016.08); *F25D 27/00* (2013.01); *F25D 27/005* (2013.01)

(58) Field of Classification Search

CPC ..... F21V 33/0044; A47B 2220/0075; A47B 2220/0077; A47B 88/919; A47B 2220/005; A47B 13/12; A47F 2007/0085; A47F 11/10; F25D 27/00; F25D 27/005

See application file for complete search history.

(56) References Cited

U.S. PATENT DOCUMENTS

| | | | | |
|---|---|---|---|---|
| 6,203,167 | B1 | 3/2001 | Liu et al. | |
| 6,749,319 | B1 * | 6/2004 | Muse | A47B 97/00 362/154 |
| 7,367,685 | B2 | 5/2008 | Moll | |
| 7,559,672 | B1 * | 7/2009 | Parkyn | F21V 5/045 362/244 |
| 7,657,344 | B2 | 2/2010 | Holmes et al. | |
| 8,090,473 | B2 | 1/2012 | Higham | |
| 8,449,050 | B2 * | 5/2013 | Karg | A47B 88/463 312/223.6 |
| 8,562,167 | B1 * | 10/2013 | Meier | A47B 96/021 362/125 |
| 8,876,314 | B2 | 11/2014 | Zhu et al. | |
| 8,966,926 | B2 | 3/2015 | Eveland et al. | |
| 10,401,018 | B1 * | 9/2019 | Smith | A47B 77/00 |
| 2002/0171335 | A1 | 11/2002 | Held | |
| 2005/0062238 | A1 * | 3/2005 | Broadfield | G16H 40/20 280/1 |
| 2006/0193126 | A1 | 8/2006 | Kuelbs | |
| 2007/0274042 | A1 | 11/2007 | Jackson et al. | |
| 2008/0180944 | A1 | 7/2008 | Galvez et al. | |
| 2010/0182772 | A1 * | 7/2010 | Wells | A45C 15/06 362/156 |
| 2011/0062897 | A1 * | 3/2011 | Li | F21V 21/043 315/362 |
| 2011/0266929 | A1 * | 11/2011 | Michael | F21V 33/0012 312/107 |
| 2011/0273867 | A1 * | 11/2011 | Horst | A47B 96/021 362/133 |
| 2013/0088868 | A1 * | 4/2013 | Slowinski | F21V 7/00 362/247 |
| 2013/0208455 | A1 | 8/2013 | Chung | |
| 2015/0115786 | A1 * | 4/2015 | Manalang | A47B 88/40 312/321.5 |
| 2015/0279251 | A1 * | 10/2015 | Matyear | H02S 40/38 362/183 |
| 2016/0022526 | A1 * | 1/2016 | Chen | A61G 12/001 312/209 |
| 2016/0047539 | A1 * | 2/2016 | Cano | F21V 33/0012 362/133 |
| 2016/0053987 | A1 | 2/2016 | Hsu | |
| 2016/0131316 | A1 | 5/2016 | Russell et al. | |
| 2016/0174733 | A1 * | 6/2016 | Cinici | A47F 7/28 312/128 |
| 2016/0303732 | A1 * | 10/2016 | Tam | E05B 37/02 |
| 2016/0313053 | A1 | 10/2016 | Eicher et al. | |
| 2017/0115052 | A1 | 4/2017 | Kendall et al. | |
| 2017/0123399 | A1 * | 5/2017 | Londo | B25H 3/00 |
| 2017/0131024 | A1 | 5/2017 | Kempfle et al. | |
| 2017/0136957 | A1 | 5/2017 | Kirtley | |
| 2017/0340112 | A1 | 11/2017 | Miles | |
| 2018/0106439 | A1 | 4/2018 | Dhali et al. | |
| 2018/0142869 | A1 * | 5/2018 | Pallai | F21V 23/005 |
| 2018/0231238 | A1 * | 8/2018 | Burch | H01M 2/1005 |
| 2018/0259178 | A1 * | 9/2018 | Miedema | F21V 33/002 |
| 2018/0306395 | A1 * | 10/2018 | Conrad | F21S 9/02 |
| 2018/0306971 | A1 * | 10/2018 | Conrad | F21V 33/0032 |
| 2018/0306972 | A1 * | 10/2018 | Conrad | F21K 9/61 |
| 2019/0086073 | A1 * | 3/2019 | Premysler | F21V 17/02 |

FOREIGN PATENT DOCUMENTS

| | | | | |
|---|---|---|---|---|
| CN | 104456479 | A | 3/2015 | |
| CN | 204604286 | U | 9/2015 | |
| DE | 102009030392 | A1 | 12/2010 | |
| EP | 3203148 | A1 * | 8/2017 | E05B 47/00 |
| GB | 1044119 | A | 9/1966 | |
| TW | 201603792 | A | 2/2016 | |
| WO | WO-2012022009 | A1 * | 2/2012 | F21V 33/0012 |

OTHER PUBLICATIONS

Australia Examination Report No. 1 for Application No. 2019219721 dated May 11, 2020, 4 pages.

Taiwan Office Action for Application No. 10920827230 dated Aug. 28, 2020, 14 pages.

Canadian Office Action for Application No. 3,052,752 dated Nov. 3, 2020, 7 pages.

Examination Report for Application No. GB1911851.2 dated Nov. 26, 2020, 3 pages.

Examination Report for Application No. 2019219721 dated Dec. 1, 2020, 4 pages.

* cited by examiner

ILLUMINATION FOR STORAGE UNITS

CROSS REFERENCES TO RELATED APPLICATIONS

This application claims priority to, and the benefit of, U.S. Provisional Patent Application Ser. No. 62/721,957, filed Aug. 23, 2018, the contents of which are incorporated herein by reference in their entirety.

FIELD OF THE INVENTION

The present invention relates to storage units, and more particularly to illumination of a containment space and/or surroundings of the storage unit.

BACKGROUND

Storage units are often used in places with lighting that causes a containment space (e.g., an interior of a drawer) to be darkened or difficult to see. In order to improve visibility, an external light source, such as a light affixed to a top surface of the storage unit or a flashlight held by a user, is typically used to shine down into the containment space. However, this solution is cumbersome and unwieldly, as the light obstructs access to the storage unit and the flashlight ties up the user's hands, which makes the task of filing or removing objects from the storage unit more difficult. Further, the entire interior of the containment space is not properly illuminated, either by limitations of the light or shadows created by the presence of large objects, which cast a shadow that occludes the far reaches of the drawer.

SUMMARY OF THE INVENTION

The present invention broadly comprises an illumination assembly integrated with a storage unit that is adapted to illuminate containment spaces of the storage unit, such as a cabinet or toolbox, by directing or radiating light into the containment space when the containment space is opened. The illumination assembly may be disposed inside of the containment space and/or on trim pieces of the storage unit adjacent to the containment space. The illumination assembly may be controlled using multiple switching elements, power sources, sensors adapted to detect a drawer open event or other event such as user presence, communication abilities, and/or a logic control circuitry.

In comparison to prior art solutions, embodiments of the invention described herein comprise a more complete lighting system in which the integration of the illumination assembly better illuminates the containment spaces of the storage unit. Further, the control of the illumination assembly is implemented in such a way as to afford many options of switching and ease of manufacturing and installation, compared to the prior art solutions.

In an embodiment, the present invention broadly comprises an illumination assembly for a storage unit having a containment space with an interior. The illumination assembly includes a light source adapted to be disposed in a recess of a structural feature of the storage unit, and radiate light towards the interior of the containment space when the light source is in an ON state. A sensor element is operationally coupled to a logic board and adapted to output a signal indicating a sensing event, and a switch is operationally coupled to the logic board and adapted to be actuated in response to the signal to control the ON and OFF states of the light source.

In another embodiment, the present invention broadly comprises a storage unit having a compartment with an interior. The storage unit includes a structural feature and an illumination assembly. The illumination assembly includes a light source disposed in a recess of the structural feature, and is adapted to be in an ON or OFF state, and, when in the ON state, radiate light towards the interior of the compartment. The illumination assembly also includes a sensor element coupled to the storage unit and adapted to output a signal indicating a sensing event, and a switch operationally coupled to the illumination assembly and the sensor element, and adapted to be actuated based on the sensing event to control the ON and OFF states of the light.

In another embodiment, the invention broadly comprises a system adapted to illuminate a containment space of a storage unit. The system includes a light source disposed in a recess of a structural feature of the storage unit adjacent to the containment space and is adapted to radiate light towards an interior of the containment space when in an ON state. A controller is in operational communication with the light source and a power source and is adapted to cause the light source to be switched between the ON and OFF states. A switch is disposed on the storage unit and is adapted to be actuated to operate the light source in the ON or OFF state. A sensor element is adapted to output a signal indicating a sensing event, and a logic board is in operational communication with the controller, the switch, the sensor element, and the power source, and is adapted to control the light source to be in the ON state when the sensor element outputs the signal indicating the sensing event.

In yet another embodiment, the invention broadly comprises a method of illuminating an interior of a containment space of a storage unit. The method includes actuating a switch disposed on the storage unit, and receiving, by a logic board, a first signal indicating a sensing event from a sensor element when the containment space is moved between closed and open states. The method may also include outputting, by the logic board, a second signal to cause a controller to change a light source from either an OFF state to an ON state or the ON state to the OFF state based on the sensing event, wherein the light source is disposed in a recess of a structural feature of the storage unit adjacent to the containment space.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
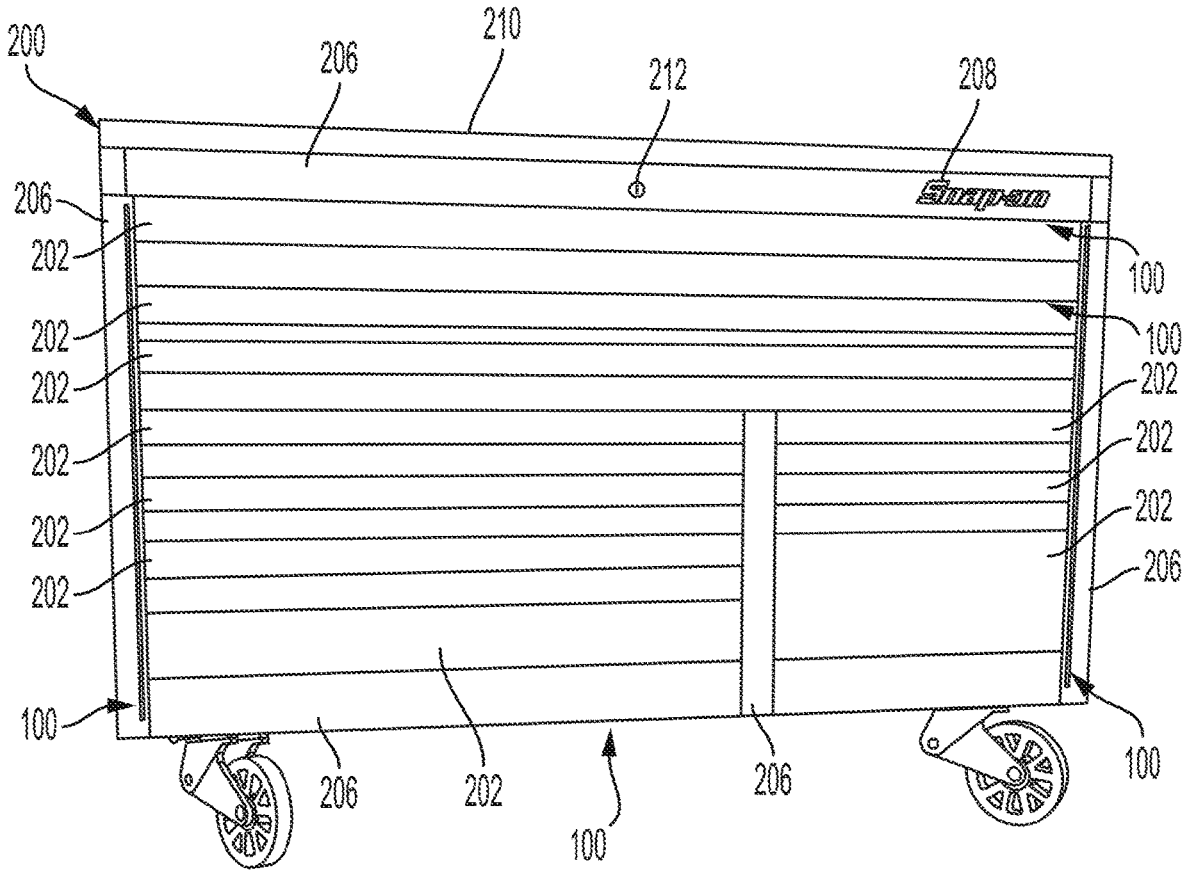
FIG. 1 is a front plan view of an illumination assembly coupled to a storage unit according to an embodiment of the present invention.

While this invention is susceptible of embodiments in many different forms, there is shown in the drawings, and will herein be described, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises an illumination assembly adapted to be coupled to a storage unit by coupling the illumination assembly within a retrofittable or integrated feature of the storage unit to direct or radiate light into a containment space (such as a drawer) of the storage unit when opened. The illumination assembly may also illuminate a facade, sides, underside, or surrounding area of the storage unit.

Referring to the Figures, an illumination assembly 100 (which may include one or more illumination assemblies 100) may be coupled to a storage unit 200 and adapted to direct or radiate light in an outwardly and/or downwardly direction relative to the storage unit. The illumination assembly 100 may be adapted to radiate light into a containment space 202 (such as a drawer) of the storage unit 200, when such containment space 202 is opened, to illuminate the contents of the containment space 202. In an embodiment, the illumination assembly 100 may be adapted to radiate light in the surrounding area of the storage unit 200.

As illustrated for exemplary purposes, the illumination assembly 100 includes a light source 102, a power source 104, a switch 106, and a sensor element 108. One or more illumination assemblies 100 may be coupled to the storage unit 200 by being disposed inside and/or outside of the containment space 202 and/or in a structural feature of the storage unit 200. For example, the illumination assembly 100 may be disposed in a recess 204 formed by a trim piece 206 of the storage unit 200 (described below), thereby enabling and facilitating modular installation and locating for differently constructed storage units. Accordingly, the illumination assembly 100 may be aesthetically integrated with the storage unit 200.

The light source 102 may be an array or single element of one or more of light emitting diodes (LEDs), incandescent, halogen, or fluorescent bulbs, or high intensity discharge (HID), mercury lamp bulbs, or the like, operationally connected to run off of the same controlling circuit and/or power source 104. The intensity of light and/or focus of the light radiating from the light source 102 may be selectively directed and aimed using lenses or optical filters to illuminate a desired containment space 202 of a number of containment spaces, a section of the containment space 202, and/or surroundings of the storage unit 200. The light source 102 may radiate light on the spectrum where the wavelength is from about 10 nm to 1000 μm. The array may include any combination of light source types.

The light source 102 may be located in one or more of any of the following locations: on an inside and/or an outside surface of the containment space 202, under a latch of the containment space 202, in one or more recesses formed in the structural feature of the storage unit 200, such as trim pieces 206 of the storage unit 200, on the top of and/or in or on a lid over the top of the storage unit 200, and/or on a bottom surface of the storage unit 200. The light source 102 may be disposed on the storage unit 200 using a bracket coupled to the storage unit in a location to radiate light towards the interior of the containment space 202.

Figure 2:
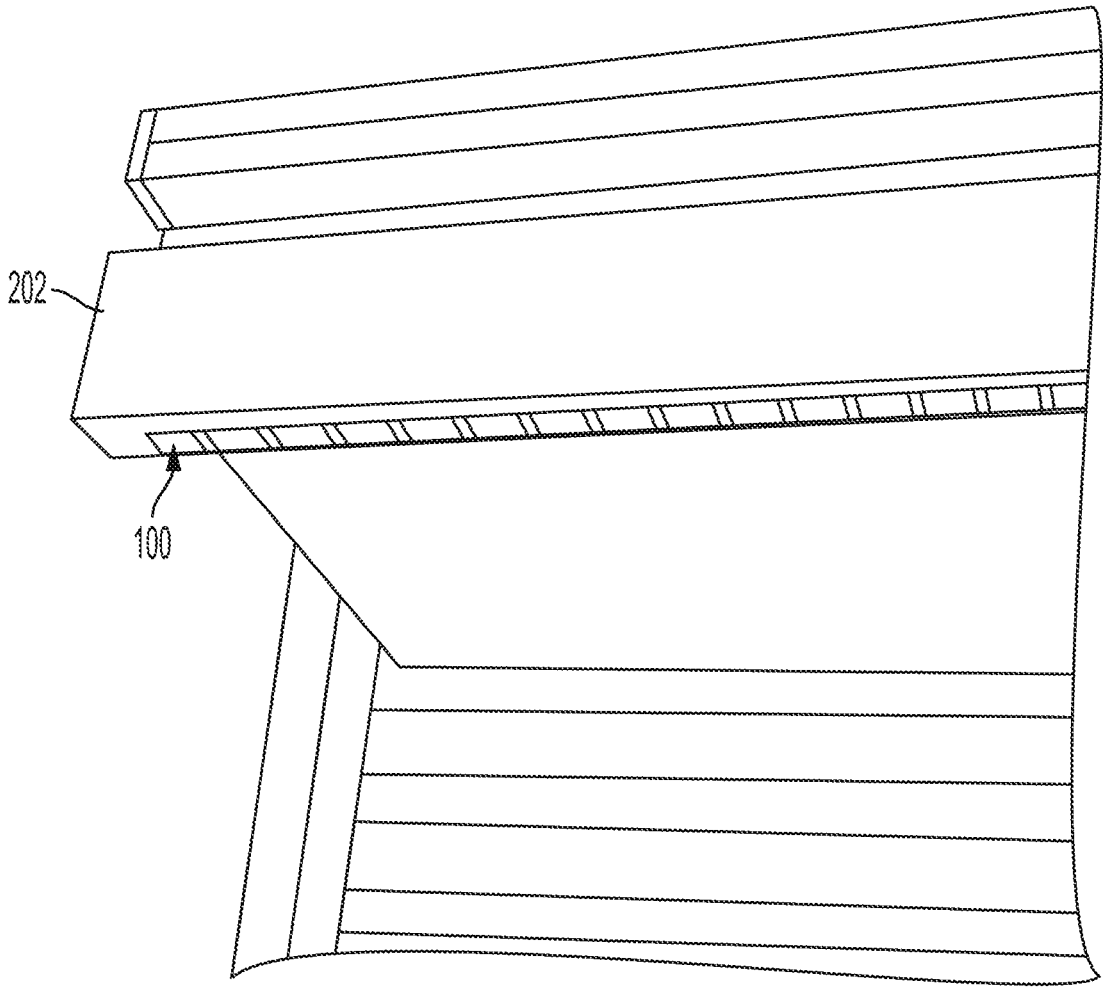
FIG. 2 is an enlarged, bottom perspective view of the illumination assembly coupled to a bottom of a drawer of the storage unit of FIG. 1.
Figure 3:
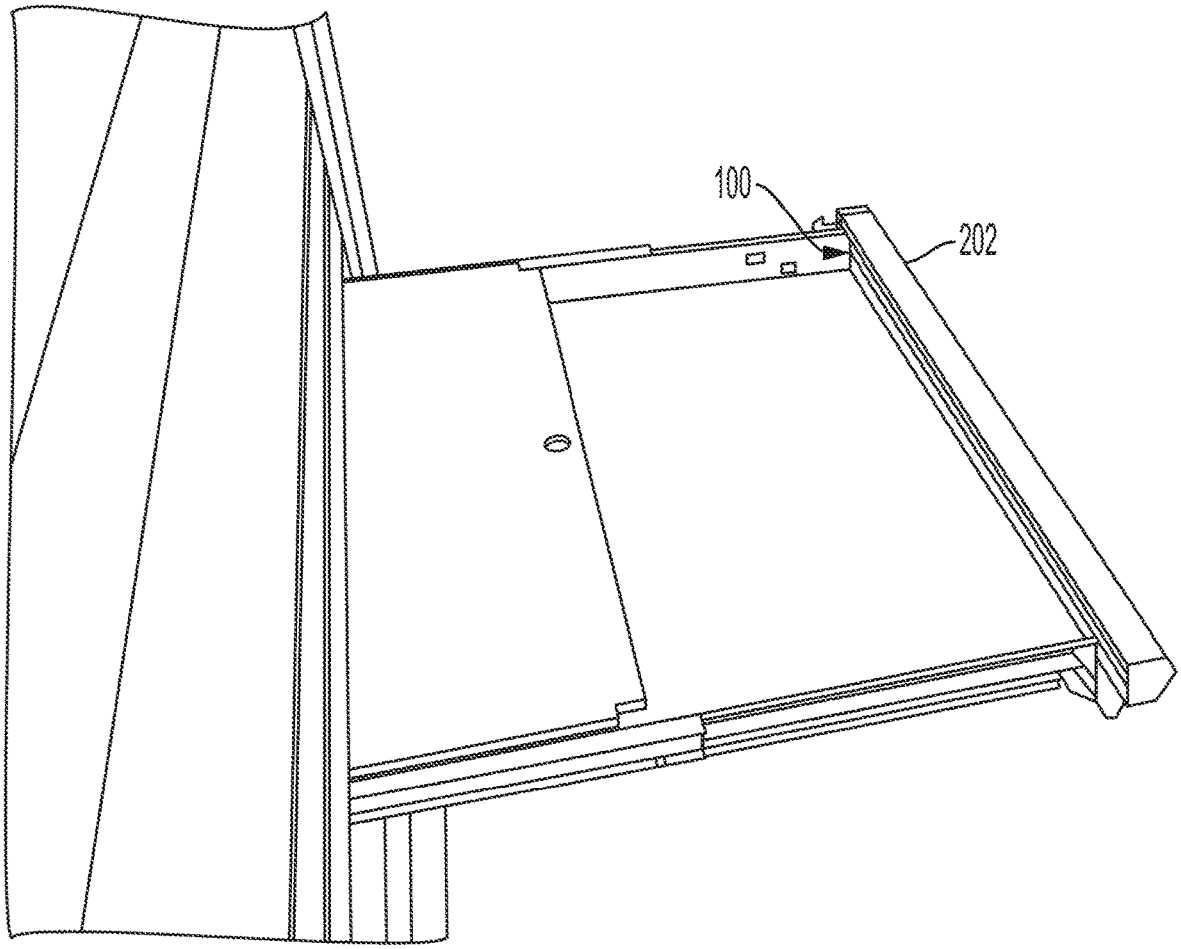
FIG. 3 is a top perspective view of the illumination assembly coupled to a side of a drawer of the storage unit of FIG. 1.

As used herein, the light source 102, whether arrays or individual bulbs or diodes, is referred to simply as the light source 102. As described above, the light source 102 may be located in a number of locations or combination of locations, such as one or more trim pieces 206 (e.g., a façade), as shown in FIG. 1. In an embodiment, the light source 102 may be disposed on an outside surface of the containment space 202 (e.g., a bottom of a drawer as shown in FIG. 2). The light source 102 may be disposed on any inside surface of the containment space 202, such as on an edge of a front inside surface as shown in FIG. 3. The light source 102 may be coupled directly or using brackets.

In an embodiment, electrical power is provided by a power source 104, such as electric battery(s), fuel cell, solar power, or from an external power supply (AC wall power) via a power cord. In an embodiment, the electrical power may be supplied as DC voltage of approximately between 9V to 60V. The electric battery may be external to the storage unit 200 or be housed within the storage unit 200, such as within a bracket of the light source 200, the trim piece 206, the containment space 202, and/or a special compartment. An adaptor to accept modular or power tool type batteries may be also provided.

A switch 106 is provided and can be adapted to turn the light source 102 ON or OFF based on the containment space 202 being in an open or closed state. The switch 106 may be a manually operated switch, a sensor type switch, such as a proximity or motion sensor that detects the proximity of a user by acoustic, optical, or other signal, etc. The switch 106 may include an actuation mechanism that employs a push button type actuator or other type of actuator to activate or operate the switch 106. In an embodiment, the switch 106 can be a toggle actuator, a touch sensitive actuator, rocker actuator, a slide actuator, magnetic, or other suitable actuator or device. A logo badge 208 may be adapted to actuate the switch 106. For example, the switch 106 may be a capacitive contact switch where a logo badge 208 is the sensing element. In another embodiment, the switch 106 may be a pressure sensitive switch that the logo badge 208 is disposed above. The switch 106 may detect the proximity of a key by a signal propagated in the electromagnetic spectrum. The switch 106 may be coupled anywhere on the storage unit 200, such as on a trim piece 206, a light bar, an outside surface of the storage unit 200 (e.g., a side, top, bottom, or lid of the storage unit 200), to be easily accessed and actuated by a hand or foot of the user.

When the illumination assembly 100 is installed in a storage unit 200 having drawers, the light source 102 may be oriented to emit or radiate light in an outwardly and/or downwardly direction into the drawers when opened. When the drawers of the storage unit 200 are opened and pulled out from the storage unit 200, the switch 106 can be actuated to electrically connect the light source 102 to the power source 104 to turn the light source 102 to the ON state, thus causing illumination. Conversely, when the drawers are closed, the switch 106 can be actuated to electrically disconnect the light source 102 from the power source 104 and turn the light source 102 to an OFF state.

The switch 106 may be actuated manually or automatically based on sensing of motion and/or the drawer being open or closed by the sensor element 108. The switch 106 may also include a timer that is adapted to actuate the switch 106 to turn the light source 102 to an OFF state after a predetermined amount of time has passed while the light source 102 has been in an ON state.

The sensing element 108 may include any number of contact and/or non-contact elements (e.g., acoustic, optical, electromagnetic, accelerometer) that are actuated by the containment space 202 being in an open or closed state. The sensor element 108 can include one or more of the following: contact switches, gate switches, magnetic reed switches, light gates, acoustic sensors, optical sensors, optical range finders, acoustic range finders, inertial sensors, etc. The sensing element may be an RF sender/detector that pings an RF transponder that is coupled to the user. As described herein, multiple methods and sensing systems may be deployed simultaneously to sense the location of the containment space 202 to determine an open/close state, and/or the presence of the user in the proximity of the storage unit 200, such as the front.

When the illumination assembly 100 is installed in a storage unit 200 with drawers, the sensing element 108 may detect the drawer's position and status. The sensing element 108 may be located on the inside of the storage unit 200 and routed in such a way as to detect any number or lay-out of drawer configurations. The sensing element 108 may be located outside of the storage unit 200 such as in the lid, the trim piece 206, the top or any location where detection of the drawers is possible.

Figure 6:
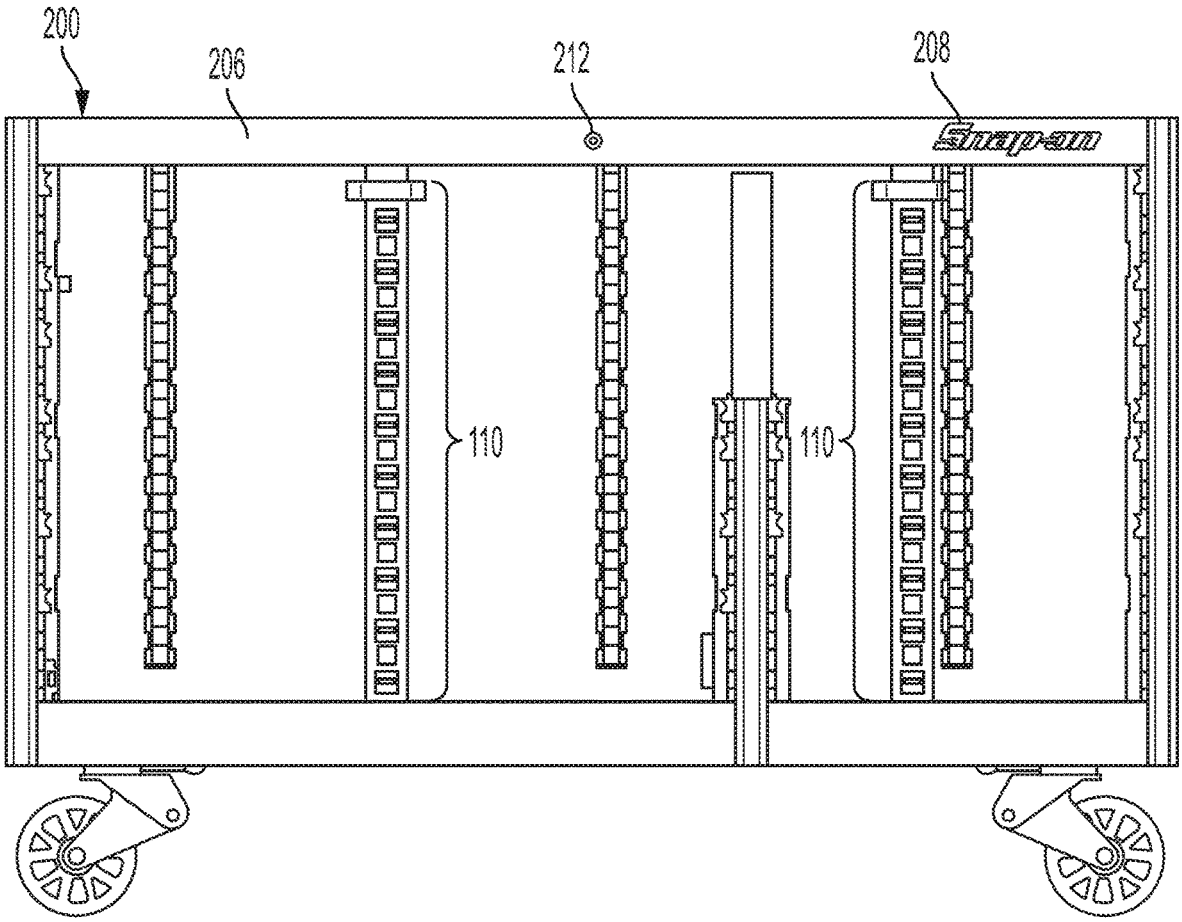
FIG. 6. is a front plan view showing an example of an interior of the storage unit of FIG. 1.

As shown in FIG. 6, in an embodiment, the sensor element 108 can be arranged as an array 110 of sensor elements and switches on an interior back surface of the storage unit 200. However, the array 110 may be placed on an interior side surface, an outside surface, and/or a lid of the storage unit 200. The array 110 can be arranged such that the open/close state of one or more containment spaces 202 are detected simultaneously and/or the presence of the user in proximity of the storage unit 200 is detected. The array 110 may also be coupled to the storage unit 200 using a bracket in order to facilitate installation.

Figure 7:
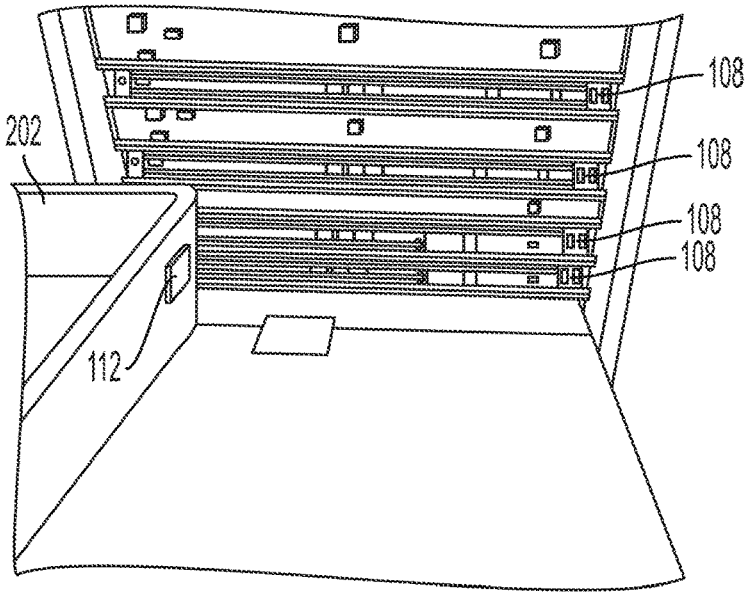
FIG. 7 is a perspective view of the interior of the storage unit illustrated in FIG. 6.
Figure 8:
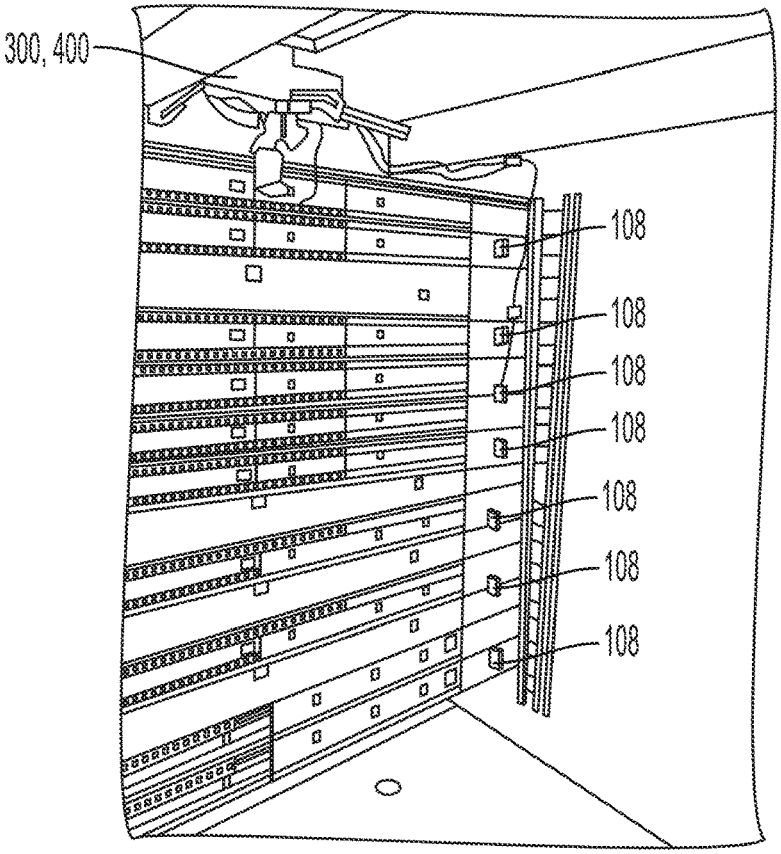
FIG. 8 is another perspective view of the interior of the storage unit illustrated in FIG. 6.

As shown in FIGS. 7 and 8, in an embodiment, the sensor element 108 can be one or more magnetic reed switches. The reed switches may be coupled to an interior surface (e.g., back) of the storage unit 200, and a magnet 112 is coupled to the containment space 202 (e.g., a drawer). As the containment space 202 is moved from a closed state to an open state, the magnet 112 moves further from the reed switch, thereby causing the switch circuit to close. A circuit board, such as a logic board 400, described in more detail below, can detect the switch circuit status as closed and activate the light source 102.

Referring now to FIGS. 9-12, simplified block diagrams of various examples of the illumination assembly 100 and electronic components, such as the light source 102, the switch 106, the sensor element 108, the power source 104, a controller 300, and the logic board 400, are illustrated. As shown, the light source 102 may be operationally coupled to a power source 104 via the switch 103 and/or the controller 300. The logic board 400 may also be included and the various components are operationally coupled or attached thereto. The light source 102, the switch 106, the sensor element 108, the power source 104, and/or the controller 300 can be operationally coupled to the logic board 400 and thus to one another via the logic board 400. Wires may be used to connect the various components to the logic board 400. Electrical contacts can also be provided between the various components and the logic board 400. The functional design of these components can vary considerably within the spirit and scope of the present invention.

Figure 9:
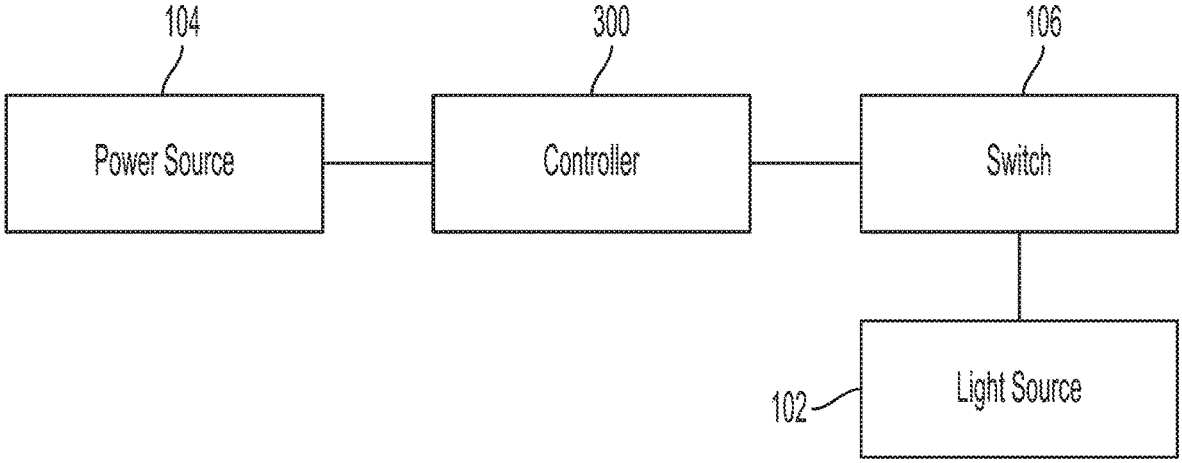
FIG. 9 is a simplified block diagram of one example of the illumination assembly and electronic components.
Figure 10:
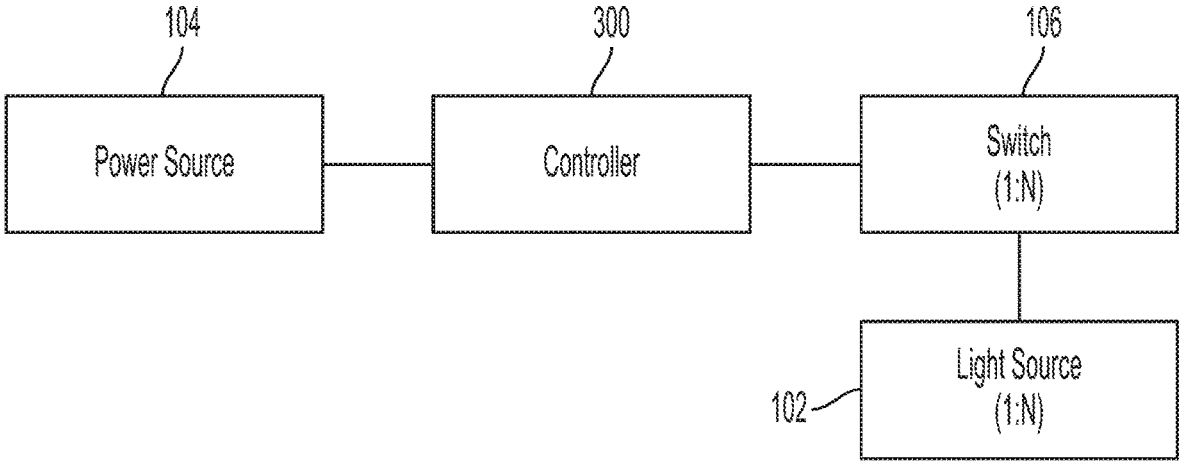
FIG. 10 is a simplified block diagram of another example of the illumination assembly and electronic components.

As shown in FIG. 9, in an embodiment, the switch 106 can be a manually operated switch that governs the power supplied to the light source 102 from the power source 104. As shown in FIG. 10, in an embodiment, the switch 106 can be a series of individual switches corresponding to each and every containment space 202 (e.g., a drawer) in the storage unit 200. When the respective containment space 202 is in an open state, the corresponding switch 106 allows power to be supplied to the light source 102 that is adapted to radiate light into the open containment space 202. As described above, the light source 102 can be turned ON when the switch circuit is closed, thus there may be one switch 106 per light source 102 (e.g., light element or light array). The switch 106 may also be controlled to stop power from being supplied to the light source 102 by a timer, and turn the light source OFF. The timer may be user configurable.

Figure 11:
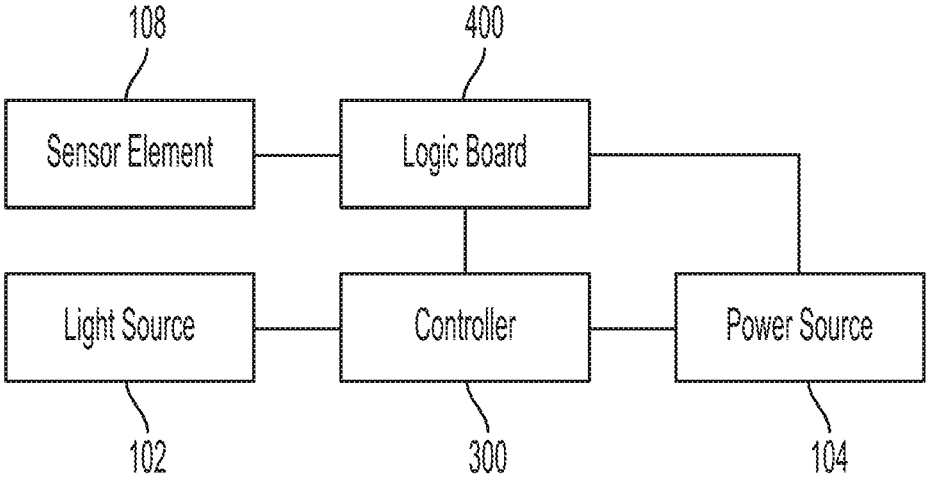
FIG. 11 is a simplified block diagram of another example of the illumination assembly and electronic components.

As shown in FIG. 11, in an embodiment, the logic board 400 can be configured to cause the controller 300 to turn ON the light source 102 based upon receiving a signal output by the sensor element 108 indicating a sensing event detected by the sensor element 108. For example, the sensor element 108 can detect the open/close state of the containment space 202 and output a signal to the logic board 400 based on that state. The logic board 400 can output a signal to the controller 300 to activate or turn ON the light source 102. Accordingly, the light source 102 will be turned ON when the containment space 202 is in the open state and/or the user is in a desired proximity to the storage unit 200. The light source 102 will be turned OFF when the containment space 202 is in the closed state and/or the user is not in the desired proximity to the storage unit 200.

Figure 12:
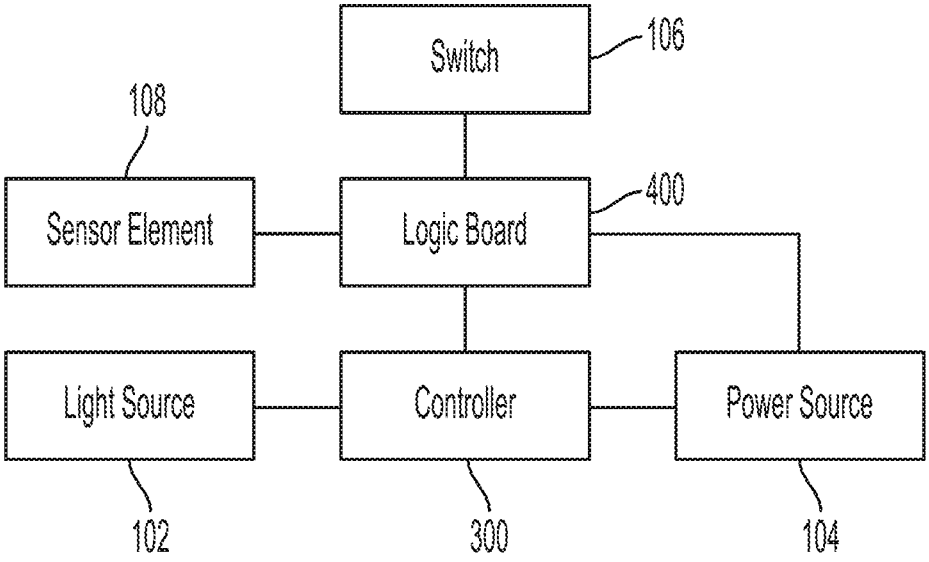
FIG. 12 is a simplified block diagram of another example of the illumination assembly and electronic components.

As shown in FIG. 12, in an embodiment, the logic board 400 can be configured to cause the controller 300 to turn ON or turn OFF the light source 102 based upon the logic board 400 receiving a signal output by the sensor element 108 indicating a sensing event detected by the sensor element 108 and a signal output from the switch 106 that the switch 106 is actuated to activate the light source 102. The sensing event signal can indicate the open/close state of the containment space 202 and/or user proximity to the storage unit 200. The switch 106 can be manually actuated or actuated by an electromagnetic signal. Accordingly, the light source 102 will be only be turned ON when the containment space 202 is in the open state and/or the user is in a desired proximity to the storage unit 200 and the switch 106 is actuated. The light source 102 will be turned OFF when the containment space 202 is in the closed state and/or the user is not in the desired proximity to the storage unit 200 and the switch 106 is not actuated.

Control logic of the logic board 400 may interface with existing technologies such as, for example, the "ECKO-Lock" and "ATC Tool Storage" systems from Snap-on Incorporated. The control logic may be able to be accessed for programming or activation via Wi-Fi, Bluetooth, cellular, Ethernet, or any other type of communication connection.

Referring to FIG. 1, an example of a storage unit 200, where the structure has a number of containment spaces 202 (e.g., drawers) and a number of structural features, such as trim pieces 206, and a top surface 210. The storage unit 200 can include any structure or housing that may have one or more drawers of varying configurations and sizes that may be fixed or moveable between open and closed states. The storage unit 200 can be a tool storage chest.

Figure 4:
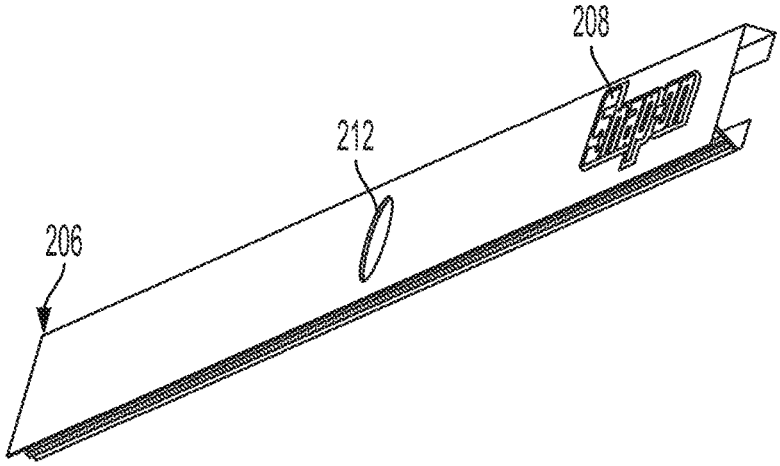
FIG. 4 is a perspective view of one example of a trim portion of the storage unit of FIG. 1 adapted to be coupled to the illumination assembly.
Figure 5:
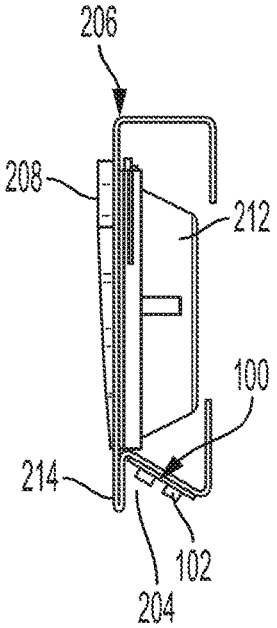
FIG. 5 is a side plan view of the trim portion of FIG. 4.

Referring to FIG. 4, the trim piece 206 can match the aesthetics of the storage unit 200 and be adapted to couple the light source 102 to the storage unit 200. Further, the trim piece 206 can be adapted to protect and aim the light source 102 to radiate light into an open containment space 202. The trim piece 206 can include one or more of a lock 212, a logo badge 208, and a formed recess 204 where the light source 102 may be coupled to and aimed at an angle of 10° to 75° to shine into the containment space 202. The formed recess 204 can aim the light source 102 to shield the direct glare from a user's eyes who stands taller than the trim piece 206. The formed recess 204 may include a cover 214, such as a lens, adapted to protect the light source 102 and/or diffuse light radiating from the light source 102. Other structural features of the storage unit 200 may include any or all of the features of the trim piece 206 described herein. The trim piece 206 may be coupled to the storage unit 200 by rivets, welds, screws, bolts, adhesive, or any other suitable means. In an embodiment, the trim piece 206 may be an integral part of the storage unit 200. The trim piece 206 may be formed of metal, plastic, or other durable material.

The illumination assembly 100 described herein may further include additional light sources, housings for the light sources, computational logic element(s), hardware to send and detect signals in the electromagnetic spectrum, and wire circuit(s).

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes or modifications may be made without departing from the broader aspects of the inventors' contribution. The actual scope of the protection sought is intended to be defined in the following claims when viewed in their proper perspective based on the prior art.

What is claimed is:

1. An illumination assembly for a storage unit having a containment space with an interior, the illumination assembly comprising:

a light source adapted to be disposed in a recess formed by a structural feature of the storage unit, wherein the structural feature includes a cover portion that at least partially forms a side of the recess and is adapted to direct light radiating from the light source towards the interior of the containment space when the light source is in an ON state;

a sensor element operationally coupled to a logic board and adapted to output a signal indicating a sensing event; and a switch operationally coupled to the logic board and adapted to be actuated in response to the signal.

2. The illumination assembly of claim 1, wherein the logic board is adapted to cause the light source to be in the ON state when the switch is actuated and the sensor element outputs the signal indicating the sensing event.

3. The illumination assembly of claim 1, wherein the light source is a light emitting diode.

4. The illumination assembly of claim 1, wherein the sensing event is the containment space being moved from a closed state to an open state.

5. The illumination assembly of claim 1, wherein the sensing event is a user being in proximity to the storage unit.

6. A storage unit having a compartment with an interior, the storage unit comprising:

a structural feature forming a recess and including a cover portion that at least partially forms a side of the recess; and an illumination assembly including:

a light source disposed in the recess and adapted to be selectively disposed in either one of an ON and OFF states, wherein the cover is adapted to direct light radiating from the light source towards the interior of the compartment when the light source is in the ON state;

a sensor element coupled to the storage unit and adapted to output a signal indicating a sensing event; and a switch operationally coupled to the illumination assembly and the sensor element, and adapted to be actuated based on the sensing event.

7. The storage unit of claim 6, wherein the structural feature is a trim piece.

8. The storage unit of claim 6, wherein the structural feature includes a lock.

9. The storage unit of claim 6, wherein the recess and the cover cooperatively direct light radiating from the light source away from eyes of a user.

10. The storage unit of claim 6, wherein the storage unit is a tool storage chest and the compartment is a drawer.

11. The storage unit of claim 6, wherein the recess aims the light source at an angle of 10° to 75° to direct light radiating from the light source into the containment space.

12. A system adapted to illuminate a containment space of a storage unit, the system comprising:

a light source adapted to be disposed in a recess formed by a structural feature of the storage unit, wherein the structural feature includes a cover portion that at least partially forms a side of the recess and is adapted to direct light radiating from the light source towards an interior of the containment space when in an ON state;

a controller in operational communication with the light source and a power source and adapted to cause the light source to be in the ON state or an OFF state;

a switch disposed on the storage unit and adapted to be actuated to place the light source in the ON or OFF state;

a sensor element adapted to output a signal indicating a sensing event; and a logic board in operational communication with the controller, the switch, the sensor element, and the power source, and adapted to cause the light source to be in the ON state when the sensor element outputs the signal indicating the sensing event.

13. The system of claim 12, wherein the sensing event is the containment space being moved from a closed state to an open state.

14. The system of claim 12, wherein the sensor element is an array of sensor elements and switches disposed on an interior surface of the storage unit.

15. The system of claim 12, wherein the sensing event is a user being in proximity to the storage unit.

16. The system of claim 12, wherein the structural feature is a trim piece.

17. A method of illuminating an interior of a containment space of a storage unit, the method comprising:

actuating a switch disposed on the storage unit;

receiving, by a logic board, a first signal indicating a sensing event from a sensor element when the containment space is moved from a closed state to an open state or from the open state to the closed state; and outputting, by the logic board, a second signal to cause a controller to change a light source from either an OFF state to an ON state or the ON state to the OFF state based on the sensing event, wherein the light source is disposed in a recess formed by a structural feature of the storage unit, wherein the structural feature includes a cover portion that at least partially forms a side of the recess and is adapted to direct light radiating from the light source towards an interior of the containment space.

18. The method of claim 17, wherein receiving the first signal includes receiving the first signal when a user is in proximity to the storage unit.

19. The method of claim 17, wherein outputting the second signal includes outputting the second signal when the switch is actuated.

20. The method of claim 17, wherein the light source is disposed in the interior of the containment space.

21. The method of claim 17, wherein the structural feature is a trim piece.

* * * * *